United States Patent [19]

Dunn, Jr. et al.

[11] Patent Number: 4,795,675

[45] Date of Patent: Jan. 3, 1989

[54] ENHANCED TRANSFER PRINTABILITY TREATMENT METHOD AND COMPOSITION

[75] Inventors: Larson B. Dunn, Jr.; Kenneth B. Moser, both of Decatur, Ill.; Panemangalore S. Pai, Charlotte, N.C.

[73] Assignee: Staley Continental, Decatur, Ill.

[21] Appl. No.: 155,388

[22] Filed: Feb. 12, 1988

Related U.S. Application Data

[62] Division of Ser. No. 908,495, Sep. 17, 1986.

[51] Int. Cl.[4] ..... D06M 13/16

[52] U.S. Cl. ..... 428/260; 427/394; 427/396; 428/270; 428/272; 428/274

[58] Field of Search ..... 428/260, 270, 272, 274; 427/394, 396

[56] References Cited

U.S. PATENT DOCUMENTS

| | | | |
|---|---|---|---|
| 2,292,921 | 8/1942 | Bock . | |
| 2,356,565 | 8/1944 | Chwala . | |
| 2,968,581 | 1/1961 | Kress . | |
| 4,033,716 | 7/1977 | Defago et al. | 8/918 |
| 4,072,462 | 2/1978 | Villins et al. | 8/918 |
| 4,155,707 | 5/1979 | Franceschini et al. | 8/917 |
| 4,207,069 | 6/1980 | Ono | 8/471 |
| 4,210,412 | 7/1980 | Vamane et al. | 8/471 |
| 4,236,890 | 12/1980 | Blanchard et al. | 8/470 |
| 4,285,695 | 8/1981 | Doerr et al. | 8/650 |
| 4,329,449 | 5/1982 | Roth . | |
| 4,492,584 | 1/1985 | Jenkins | 8/471 |

OTHER PUBLICATIONS

Transfer Printing–Present Stage of Technical Development and Future Development Trends, *Melliand Textilbrechte* (English Edition), Nov. 1980, pp. 1487–1494.

Transfer Printing Cotton and Cotton Blends, Blanchard et al; *American Dyestuff Reporter,* Jul. 1976, pp. 26, 32, 34 & 65.

Transfer Printing—Present Stage of Technical Development and Future Development Trends, *Melliand Textilberichte* (English Edition) Oct., 1980, pp. 1372–1378.

Heat Transfer Printing, paper presented by Ben A. Cromer, Jr. at the AAM–MQC Spring Meeting on Apr. 9–10, 1975 in Nashville, Tenn.

A Book Entitled "Printing on Textiles by Direct and Transfer Techniques", Edited by R. W. Lee, pp. 341–370, in particular, pp. 347–349, Noyes Data Corp., New Jersey.

Dyes for Heat Transfer Printing, Nishida et al., *American Dyestuff Reporter,* Feb. 1975, pp. 46–52.

*Primary Examiner*—James C. Cannon

*Attorney, Agent, or Firm*—Michael F. Campbell; James B. Guffey; J. Daniel Wood

[57] ABSTRACT

The transfer printability of fabric materials containing at least a minor proportion of cellulosic or natural proteinaceous fibers such as, for example, cotton, rayon, cellulose acetate, wool, silk, etc. is notably improved by a treatment in which said fabric material is impregnated with certain glycoside reagents. Especially preferred glycoside reagents for use in such treatment are $C_2$–$C_6$ alkyl monoglucosides.

13 Claims, No Drawings

ENHANCED TRANSFER PRINTABILITY TREATMENT METHOD AND COMPOSITION

This is a division of application Ser. No. 908,495, filed Sept. 17, 1986.

BACKGROUND OF THE INVENTION

This invention relates to a method and composition for treating fabrics to impart improved heat transfer printability thereto and to the heat transfer printing of fabrics which have been so-treated.

Heat transfer printing is a method commonly used in the textile industry to impart a desired color pattern to a fabric substrate. In accordance with this method, a color pattern to be imparted to the fabric substrate, e.g., a woven or knitted material or carpet, is initially prepared as a print on a heat transfer sheet, conventionally paper. The inks used for preparing the printed pattern are selected to volatilize or sublime at a temperature acceptable to the fabric substrate. The transfer sheet is placed in contact with the fabric to be printed and heat is applied. As a result, the inks are transferred by heat to the fabric. The fabric must be of such a nature that it will receive and retain the transferred inks, so as to give a permanent print on the fabric. The mechanism of the transfer step is believed to be that the gases resulting from volatization or sublimation of the respective inks are absorbed by at least the outer surface layers of the individual fibers of the fabric. This effect can readily be obtained on many fabrics made from synthetic fibers, especially polyester fibers. As a result, large quantities of polyester fabric printed in this manner have been produced commercially. The method is relatively quick, simple to carry out, cheap in materials and labor, and results in a good permanent print in as many colors as are imparted to the original transfer sheet, and further results in low effluent wastes.

On the other hand, this technique has met with considerable difficulty when applied to fabrics containing cellulosic fibers such as cotton, rayon and cellulose acetate; wool and other animal fibers; and other natural fibers such as silk and blends of such cellulosic and/or natural fibers with polyester and other synthetics. Primarily such blends are of a polyester and cotton, but others are within the scope of this disclosure. When transfer printing is attempted on fabrics containing such cellulosic and/or natural fibers and blends, the resulting print has been generally poor because the disperse dyes do not adhere to the natural and/or cellulosic fibers.

As a result of the foregoing, numerous attempts have been made in the past to improve the heat transfer printing characteristics of textile fabrics containing the aforementioned cellulosic and natural proteinaceous fibers. Such prior art attempts have generally included resin pre-treatment such as that disclosed in U.S. Pat. No. 4,492,584 to Jenkins (issued Jan. 8, 1985; various crosslinking treatments such as those discussed within the Background of the Invention section of the indicated Jenkins' patent; and chemical modification treatment (e.g., cyanoethylation or benzoylation) as discussed in the article by Prof. Dr. H. Herlinger entitled "Transfer Printing-Present Stage of Technical Development and Future Development Trends", *Melliand Textilberichte* [English Edition], November, 1980, pages 1487–1494.

Prior art attempts have also included the use of polyhydric alcohols and derivatives thereof such as polyethylene glycol and polyethylene glycol monoethers as swelling agents for cellulosic fiber-containing fabric materials. However, according to the aforementioned article by Dr. Herlinger, the wash fastness of transfer printed cellulosic fabric subjected solely to swelling agent pre-treatment is very poor. Additionally, the present inventors have observed that transfer printed cellulosic fabric subjected solely to such conventional polyhydric alcohol swelling pre-treatment is also generally deficient in its colorfastness to dry and wet crocking.

SUMMARY OF THE INVENTION

It has now been discovered that the transfer printability of cellulosic and natural proteinaceous fiber-containing textile fabrics can be notably improved by a treatment in which said fabric is impregnated with a glycoside reagent such as lower alkyl or alkenyl glycosides, aryl (e.g., phenyl, benzyl, etc.) glycosides and the like. Accordingly, the present invention, in one of its aspects, is a method of imparting improved transfer printability to a textile fabric which is composed at least in part of natural proteinaceous or cellulosic fibers, said method comprising the step of impregnating said textile fabric with an effective amount of a glycoside reagent of the formula:

$$RO(R'O)_y(Z)_x \qquad A$$

wherein R is a monovalent organic radical containing from 2 to about 8 carbon atoms; O is an oxygen atom; R' is a divalent hydrocarbon radical containing from 2 to about 4 carbon atoms; y is a number having an average value of from 0 to about 12; Z represents a moiety derived from a reducing saccharide containing 5 or 6 carbon atoms; and x is a number having an average value of from 1 to about 5.

The novel treated fabric material resulting from the foregoing treatment method comprises a textile fabric substrate which is composed at least in part of natural proteinaceous or cellulosic fibers and which has distributed therein, on a dry fabric substrate weight basis, from about 0.5 to about 20 weight percent of a glycoside reagent of the formula A above. Such treated fabric materials may be manufactured and sold as articles of commerce for subsequent transfer printing by others or, if desired, may be immediately transfer printed following the indicated treatment method or operation.

In another of its aspects, the present invention is a method of transfer printing a textile fabric which is composed at least in part of natural proteinaceous or cellulosic fibers, said method comprising the steps of (a) saturating said textile fabric with an aqueous solution comprising the above-described glycoside reagent; (b) drying the resulting saturated textile fabric thereby providing a substantially dry, impregnated textile fabric; and (c) transfer printing onto the dried, impregnated textile fabric by contacting said fabric with a transfer printing paper containing a coating of a disperse dye composition thereon at an elevated temperature for a time sufficient to cause at least a portion of the disperse dye composition to vaporize and to migrate from the surface of the printing paper to the textile fabric.

An especially noteworthy feature or benefit associated with the present invention resides in the fact that transfer printed cellulosic or natural proteinaceous fiber-containing fabric treated in the foregoing fashion exhibits substantially better dry and wet crockfastness properties (i.e., resistance to dye loss from the surface of the printed fabric surface upon rubbing, under either wet or dry conditions, against the surface of another fabric substrate) than are obtained when conventional polyhydric alcohol treatments are employed.

In yet another of its aspects, the present invention resides in an aqueous textile treatment composition which comprises a solution containing from about 1 to about 10 parts by weight of a melamine formaldehyde crosslinking agent in combination with from about 1 to about 20 parts by weight of the above-described glycoside reagent. As manufactured, transported and marketed, such composition is typically in the form of a concentrated aqueous solution wherein from about 0.2 to about 30 parts by weight of water is present per part of combined weight of the melamine formaldehyde and glycoside reagent ingredients. As ultimately utilized in the textile fabric treatment operations of interest, such concentrated aqueous solutions are typically diluted with water such that, on a total diluted composition weight basis, the glycoside reagent generally constitutes from about 1 to about 20 weight percent of such composition and the melamine formaldehyde component typically constitutes from about 1 to about 10 weight percent thereof.

DETAILED DESCRIPTION OF THE INVENTION

Textile fabrics to which the present invention is beneficially applicable include those which are wholly (i.e., 100% on a textile fiber weight basis) or at least partially (e.g., 10, 15, 25, 30, 35, 50, etc. or more weight percent on a total textile fiber weight basis) composed of natural, semi-synthetic or regenerated cellulosic fibers (such as, for example, cotton, cellulose acetate, rayon, etc.) and/or natural proteinaceous fibers (such as, for example, wool, silk, etc.) which in their normal or natural (i.e., untreated) state have a poor affinity for the disperse dye materials employed in conventional transfer printing operations. Such fabrics can suitably be in the form of woven or knitted materials or in the form of tufted items such as carpeting, etc. Textile fabrics for the treatment of which the present invention is particularly well suited include those composed of blends of polyester and cotton fibers and those composed solely of cotton fibers (i.e., 100% cotton fabrics).

Glycoside reagents suitable for use herein include those of the formula A above wherein the $C_2$–$C_8$ monovalent organic radical, R, is a saturated aliphatic group such as, for example, alkyl, hydroxy-alkyl, etc.; an unsaturated aliphatic group such as alkenyl, alkynyl, etc; an aromatic group such as phenyl, benzyl, etc.; and the like.

Especially preferred glycoside reagents for use herein include those corresponding to the formula A above wherein R is an alkyl or hydroxyalkyl group containing from 2 to about 8 carbon atoms such as, for example, ethyl, hydroxyethyl, n-propyl, isopropyl, hydroxypropyl, n-butyl, isobutyl, n-pentyl, n-hexyl, 2-ethylhexyl, etc.; O is an oxygen atom; R' is a divalent hydrocarbon radical containing from 2 to about 4 carbon atoms such as ethylene, propylene or butylene [preferably the unit $(R'O)_y$ represents repeating units of ethylene oxide, propylene oxide and/or random or block combinations thereof]; y is a number having an average value of from 0 to about 12 (advantageously y=0); Z represents a moiety derived from a reducing saccharide containing 5 or 6 carbon atoms (most preferably a glucose moiety); and x is a number having an average value of from 1 to about 5 (preferably from 1 to about 3 and most preferably from 1 to about 1.5).

Particularly preferred glycoside reagents of the formula A above for use herein include those wherein the aglycone group, R, is an alkyl or hydroxyalkyl group containing from 2 to about 6 carbon atoms (especially n-butyl).

Glycoside reagents of the formula A above wherein the R group is methyl (e.g., methyl glucoside) have been found to provide some discernible degree of improved transfer printability to cellulosic fiber-containing textile fibers. However, the magnitude of improved transfer printability is substantially more pronounced when $C_2$–$C_8$ alkyl, hydroxyalkyl, alkenyl, alkaryl, arylalkyl, etc. glycosides are employed in accordance with the presently claimed invention.

The glycoside materials of the formula A above can suitably be in the form of the glycoside per se (e.g., wherein the saccharide hydroxyls on the moiety Z in other than the aldehyde or ketone carbon position are "free" or unsubstituted) or, if desired, one or more of said saccharide hydroxyls can have been derivatized with a suitable derivatizing moiety. Thus, for example, glycoside derivatives suitable for use herein also include those of the formula A above in which one or more of the normally free (i.e., unreacted) hydroxyl groups of the saccharide moiety, Z, have been alkoxylated (preferably, ethoxylated or propoxylated) so as to attach one or more pendant alkoxy or poly (alkoxy) groups in place thereof. In such event, the amount of alkylene oxide (e.g., ethylene oxide, propylene oxide, etc.) employed will typically range from about 1 to about 20 (preferably from about 3 to about 10) moles thereof per mole of saccharide moiety within the formula A glycoside material.

In glycosides of the formula A above, the $RO(R'O)_y$ group is generally bonded or attached to the aldehyde or ketone carbon atom (e.g., the number 1 carbon atom in the case of glucosides) of the saccharide moiety, Z. Accordingly, the free hydroxyls available for alkoxylation are typically those in locations other than the aldehyde or ketone carbon position. Methodology suitable for the preparation of such alkoxylated glycoside derivatives is described in U.S. Pat. No. 3,640,998 to Mansfield et al, issued Feb. 8, 1972.

In practicing the present invention, the cellulosic or natural proteinaceous fiber-containing textile fabric of interest is first impregnated with the above described glycoside reagent and is then subsequently (i.e., at some later time) transfer printed in accordance with conventional transfer printing methodology.

Preferably, the aforementioned impregnation step is conducted by saturating the textile fabric of interest with a treatment solution (most preferably an aqueous solution) of the glycoside reagent; removing excess treatment solution from the saturated fabric in a conventional manner such as, for example, by squeezing (e.g., in the nip of juxtapositioned rollers); and then drying the resulting treated fabric (e.g., at a temperature of from about 100°–150° C.) to remove the treatment solution solvent (e.g., water) therefrom.

Typically, the concentration of the glycoside reagent in the treatment solution is from about 1 to about 20 (preferably from about 2.5 to about 12.5) weight percent on a total treatment solution weight basis and the final addition level of such reagent on the treated fabric material is typically from about 0.5 to about 20 (preferably from about 1 to about 10, more preferably about 2 to about 8 and most preferably from about 3 to about 6) weight percent on a dry fabric weight basis.

The step of saturating the fabric material with the glycoside treatment solution can be accomplished in any convenient, conventional manner such as, for example, via immersion in an impregnating bath, by spraying or slop padding, by foam application techniques, etc. Typically such saturation step is conducted at a temperature of from about 10° to about 40° C. and at a wet pickup of from about 50 to about 100 (preferably from about 60 to about 80) weight percent on a dry fabric weight basis.

If desired (and oftentimes preferably) conventional auxiliary treatments and/or treating agents such as, for example, crosslinking agents (e.g., melamine formaldehyde crosslinking agents, etc.), water repellents, softening agents, self-crosslinking acrylic copolymers (e.g., for enhanced wash fastness), wetting agents, etc. can be utilized in admixture with the herein described glycoside treatment solution or as a separate treatment step in conjunction with the hereindescribed glycoside treatment method.

In an especially preferred embodiment, the above-described glycoside treatment solution further comprises a melamine formaldehyde crosslinking agent. Such embodiment is particularly beneficial insofar as the treatment with such a combined glycoside/melamine formaldehyde treatment solution provides both enhanced heat transfer printability and improved colorfastness to washing. Surprisingly, the usage of the melamine formaldehyde in combination with the glycoside reagent permits the subsequent curing of the melamine formaldehyde crosslinking agent in the absence of conventionally employed curing catalysts such as, for example, magnesium chloride, aluminum chloride amine hydrochloride, zinc nitrate and mixtures thereof amongst themselves and/or with carboxylic acids such as citric acid, glycolic, and tartaric acid, and the like. This latter feature is particularly beneficial and desirable since such catalyst materials commonly impart unwanted stiffness to melamine formaldehyde treated fabric materials.

The novel treatment solution employed in this particular embodiment is preferably an aqueous solution comprising, on a total solution weight basis, from about 3 to about 15 weight percent of the above-described glycoside reagent and from about 2 to about 8 weight percent of a conventional melamine formaldehyde crosslinking agent. Optionally, such treatment solutions can also comprise up to about 0.5 weight percent of a conventional wetting agent ingredient (preferably an ethoxylated alcohol nonionic surfactant) and/or up to about 5 weight percent of a conventional fabric softening ingredient (e.g., fatty acid amide fabric softener ingredients) as well as other conventionally employed fabric treatment reagents. Typically, such composition will contain from about 75 to about 95 weight percent water on to total composition weight basis.

Following treatment in the above-stated fashion, the resulting treated fabric material can be satisfactorily printed using conventional transfer printing techniques. Typically, this entails contacting said treated fabric with a transfer printing paper containing a coating (generally a multicolored, patterned coating) of a disperse dye composition thereon at an elevated temperature (e.g., typically in the range of from about 175° to about 210° C.) for a time (typically in the range of from about 10 to about 30, preferably from about 15 to about 25, seconds) sufficient to cause at least a portion of the disperse dye composition to vaporize and to migrate from the surface of the printing paper to the textile fabric.

The fabric treatment method, treated fabric and treatment composition of the present invention are suitable for use in connection with transfer printing operations utilizing all types of disperse dye materials conventionally employed in such operations. Specific examples of suitable disperse dyes for use herein include Disperse Blue 289, Disperse Blue 326, Disperse Blue 72, Disperse Red 11, Disperse Red 60, Disperse Red 280, Disperse Blue 347, Disperse yellow 54, Disperse Yellow 181, and the like. Especially preferred dyes for use herein are those which inherently have good lightfastness properties (i.e., resistance to fading upon exposure to normal sunlight.) Nonetheless, the methods and compositions of the present invention are also suitably employed in connection with transfer printing operations utilizing dyes not having especially good inherent U.V. stability properties. In this latter instance, however, it will generally be preferred to also utilize a conventional U.V. stabilizer ingredient in connection with the transfer printing of those types of fabric substrates (e.g., drapery fabrics, upholstery fabrics, etc.) which are required to resist fading upon prolonged exposure to direct sunlight or other sources of U.V. radiation.

Following transfer printing, the resulting printed fabric materials can suitably be (and oftentimes preferably are) post-treated with reagents (e.g., crosslinking reagents such as precatalyzed dimethylol dihydroxyethylene urea, acrylic polymer emulsions, etc.) adapted or designed to impart enhanced colorfastness-to-washing properties to the printed fabric materials. Such post-treatment operations are suitably conducted in the conventional fashion in the treatment of the glycoside-treated fabrics of the present invention.

The present invention is further illustrated and understood by reference to the following examples thereof in which all parts and percentages are stated on a total weight basis unless otherwise indicated.

CONTROL 1—UNTREATED FABRIC FOR COMPARATIVE PURPOSES

Swatches of fabrics formed of a 100% cotton and a 50/50 blend of polyester and cotton are used with no preliminary finishing treatment. These fabrics are heat transfer printed with a variety of color patterns at 210° C. for 20 seconds on a Lemaire Transfer printing calendar machine. The color levels of the resulting fabrics are measured using a spectrophotometer which works in conjunction with a computer comparing colorimetric values and color differences of surface color.

These swatches exhibited poor transfer printability due to the cotton fiber therein being unreceptive to the disperse dye materials.

EXAMPLE 1

A second set of the 100% cotton and 50/50 polyester/cotton blend fabric swatches is treated with an aqueous solution containing, on a total solution weight basis, 7.5% butyl glucoside and 0.5% of a 6–8 mole ethoxylate of decyl alcohol (a wetting agent available from American Hoechst Corp. as Hostapur DAD). Such solution is padded onto the fabric and roll squeezed to obtain 80% wet pickup. The fabric is then dried at 150° C. for 2 minutes in an oven. The color intensity and brilliance of the resultant fabrics transfer printed by the technique described in Control 1 above is excellent, indicating good disperse dye affinity. Further, and quite importantly, there is practically no change in the fabric hand. The characteristics of colorfasteness to light, crocking and dry cleaning are quite satisfactory.

EXAMPLE 2

A sample of a 50/50 polyester/cotton knitted fabric is treated with an aqueous solution containing 7.5% methyl glucoside, 0.5% Hostapur DAD wetting agent and 3% of a fatty acid amide textile softener available from Henkel Corporation as Stansoft 2597. The fabric is then dried and transfer printed as in Control 1 and Example 1. The resulting printed fabric showed a slightly improved color level in comparison to the Control 1 results while in comparison to Example 1 it showed a decreased color yield.

EXAMPLE 3

Samples of 100% cotton print cloth and 50/50 polyester/cotton woven sheeting fabrics are treated and printed in the same manner as in Example 1 with the following textile softeners also being included in the treatment bath.

(a) 5% Stansoft 300 (Henkel Corp.)

(b) 5% Standafin CX-564 (Henkel Corp.)

The resulting fabrics after printing in both cases exhibit very good color yield and brilliance and also exhibit an excellent hand.

The colorfastness to drycleaning and to light are commercially acceptable. The colorfastness to dry and wet crocking are 5 and 4.5, respectively, and are thus excellent.

(Ratings: 5=Best; 1=Poor)

The colorfastness to washing is moderately satisfactory.

EXAMPLE 4

Another fabric made of 40/60 polyester/rayon upholstery material is treated and printed in substantially the same manner as in Example 3 with an additional oil and water repellent and stain resistant finishing agent of the following commercial types.

2% Scotchgard FC-247 (3M Company) or

2% Nuva TP-2177 (American Hoeschst Corp.)

The resulting fabric samples exhibit excellent color levels and commercially acceptable dry and wet crockfastness (Rating 4.5), as well as a minimum of 40 hour lightfastness. The colorfastness to washing is moderate.

EXAMPLE 5

Fabric samples of the same type as chosen in Example 3 are treated in a similar manner with butyl glucoside, wetting agent and textile softener and then transfer printed. The printed samples are subsequently post treated with an aqueous durable press treatment solution containing 35% Aerotex Resin 933 (a 45% aqueous solution of precatalyzed dimethylol dihydroxyethylene urea crosslinking agent from American Cyanamide Company); 2% Standapon 4413 (Foaming Agent from Henkel Corp.); and 10% Stansoft 2597 (Textile softener from Henkel Corp.).

The above durable press treatment is carried out using a foam finishing technique (FFT) on a Gaston County unit. The wet pickup is in the range of 35%. The fabrics are dried at 125° C. and cured at 160° C. for 90 seconds.

The resulting fabric samples exhibit good colorfastness to washing in addition to all of the commercially acceptable results as described in Example 3.

EXAMPLE 6

Fabric samples of the same type as in Example 3 are treated and printed in similar manner as in Example 3 and post treated with the following commercially available acrylic emulsion products.

3% Emulsion E-1618 (Rohm and Haas Co.) or

3% Rhopolex HA-24 (Rohm and Haas Co.) or

3% 76 RES 6930 (Union 76 Chemicals Co.) or

3% 76 RES 3104 (Union 76 Chemicals Co.)

The indicated post treatment is carried out by a padding process with a wet pickup of 70%. The fabrics are then dried at 150° C. for 60 seconds. The resulting fabrics exhibit good colorfastness to washing while retaining commercial acceptability of the other fabric properties of interest.

EXAMPLE 7

Samples of polyester/cotton fabrics composed of 50/50, 65/35 and 70/30 blend ratios are selected and treated and transfer printed in the same manner as in Example 3. The resulting fabrics exhibit increasingly good color levels and wash fastness properties as the polyester ratio is increased from 50% to 70%, while still retaining other desirable physical properties.

EXAMPLE 8

Samples of 50% polyester/50% cotton woven sheeting material and knitted jersey fabric are selected and treated with an aqueous pad bath composition containing:

a. 10% butyl glucoside;

b. 0.5% Hostapur DAD (wetting agent from American Hoechst Corp.);

c. 5.0% Stansoft 300 (softener from Henkel Corporation);

d. 6.0% Aerotex 3730 (Melamine formaldehyde crosslinking agent from American Cyanamid Company) or Aricel PC-6A (Methoxy Melamine Formaldehyde Resin from Astro Industries, Inc.); and e. water as the remainder of the composition.

No catalyst is used. The solution is padded onto fabric swatches to 80% wet pickup. The fabrics are then dried at 110° C. for approximately 5 minutes and are transfer printed in accordance with Example 3. The resulting fabrics after transfer printing show good color transfer levels; are excellent from the standpoint of wash-fastness; and exhibit an excellent hand. The colorfastnesses to dry and wet crocking as well as to light are also commercially acceptable.

Samples of fabric treated in accordance with this example are tested for formaldehyde content in accordance with AATCC Method 112-1984 using high performance liquid chromatography (HPLC) for formaldehyde detection and are found to contain about 400 ppm formaldehyde on a fabric specimen weight basis and are thus commercially acceptable with regard to this parameter. Such formaldehyde values evidence and illustrate the crosslinking and scavenging effects provided by the butyl glucoside reagent.

Printed fabric samples produced in accordance with this example exhibit excellent resistance to shrinkage.

While the present invention has been described and illustrated herein by reference to certain specific embodiments and examples thereof, such is not to be interpreted as in any way limiting the scope of the instantly claimed invention.

What is claimed is:

1. A method of imparting improved transfer printability to a textile fabric which is composed at least in part of cellulosic or natural proteinaceous fibers, said method comprising the step of impregnating said textile fabric with an effective amount of a glycoside reagent of the formula:

$$RO(R'O)_y(Z)_x \qquad A$$

wherein R is a monovalent organic radical containing from 2 to about 8 carbon atoms; O is an oxygen atom; R′ is a divalent hydrocarbon radical containing from 2 to about 4 carbon atoms; y is a number having an average value of from 0 to about 12; Z represents a moiety derived from a reducing saccharide containing 5 or 6 carbon atoms; and x is a number having an average value of from 1 to about 5.

2. The method of claim 1 wherein y is 0, Z is a glucose moiety, R is an alkyl or hydroxyalkyl group having from 2 to about 6 carbon atoms and x has an average value of from 1 to about 3.

3. The method of claim 2 wherein R is an alkyl group containing from 2 to about 6 carbon atoms.

4. The method of claim 3 wherein x has an average value of from 1 to about 1.5.

5. The method of claim 4 wherein R is an n-butyl group.

6. The method of claim 1 wherein the textile fabric is impregnated with the glycoside reagent by contacting said fabric with an aqueous solution of said glycoside reagent and thereafter drying the impregnated textile fabric.

7. The method of claim 6 wherein the glycoside reagent constitutes from about 1 to about 20 weight percent of the aqueous glycoside solution.

8. The method of claim 6 wherein, on a dry solids weight basis, from about 1 to about 10 parts of the glycoside reagent is impregnated into said textile fabric for every 100 parts by weight of said fabric treated in accordance with said method.

9. The method of claim 8 wherein said fabric is sprayed with said aqueous solution of glycoside reagent.

10. The method of claim 8 wherein said fabric is immersed in said aqueous glycoside solution.

11. The method of claim 6 wherein the textile fabric is composed of a blend of polyester and cotton fibers.

12. The method of claim 6 wherein the textile fabric consists essentially of cotton.

13. A treated fabric material which is composed at least in part of cellulosic or natural proteinaceous fibers and which has distributed therein, on a dry fabric substrate weight basis, from about 0.5 to about 20 weight percent of a glycoside reagent of the formula:

$$RO(R'O)_y(Z)_x \qquad A$$

wherein R is a monovalent organic radical containing from 2 to about 8 carbon atoms; O is an oxygen atom: R′ is a divalent hydrocarbon radical containing from 2 to about 4 carbon atoms; y is a number having an average value of from 0 to about 12; Z represents a moiety derived from a reducing saccharide containing 5 or 6 carbon atoms; and x is a number having an average value of from 1 to about 5.

* * * * *